US007872659B2

(12) United States Patent
Seetzen

(10) Patent No.: US 7,872,659 B2
(45) Date of Patent: Jan. 18, 2011

(54) WIDE COLOR GAMUT DISPLAYS

(75) Inventor: Helge Seetzen, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 774 days.

(21) Appl. No.: 11/831,922

(22) Filed: Jul. 31, 2007

(65) Prior Publication Data

US 2007/0268695 A1 Nov. 22, 2007

Related U.S. Application Data

(63) Continuation of application No. 11/722,707, filed as application No. PCT/CA2004/002200 on Dec. 24, 2004.

(60) Provisional application No. 60/638,122, filed on Dec. 23, 2004.

(51) Int. Cl.
*G09G 5/10* (2006.01)

(52) U.S. Cl. ..... 345/690; 345/214; 345/84; 345/102

(58) Field of Classification Search ..... 345/39, 345/42, 48, 60, 63, 68, 87, 88, 91, 101, 204, 345/84, 214, 690
See application file for complete search history.

(56) References Cited

U.S. PATENT DOCUMENTS

| | | | | |
|---|---|---|---|---|
| 5,107,354 | A | 4/1992 | Yamazaki et al. | |
| 6,570,584 | B1 | 5/2003 | Cok et al. | |
| 6,648,475 | B1 | 11/2003 | Roddy et al. | |
| 6,791,636 | B2 | 9/2004 | Paolini et al. | |
| 7,075,242 | B2 | 7/2006 | Miller et al. | |
| 7,091,523 | B2 | 8/2006 | Cok et al. | |
| 7,142,179 | B2 | 11/2006 | Miller et al. | |
| 7,184,067 | B2 | 2/2007 | Miller et al. | |
| 7,320,531 | B2 | 1/2008 | West et al. | |
| 2002/0006044 | A1 * | 1/2002 | Harbers et al. | 362/555 |
| 2002/0030996 | A1 | 3/2002 | Sakakibara | |
| 2002/0050958 | A1 | 5/2002 | Matthies et al. | |
| 2002/0159002 | A1 | 10/2002 | Chang | |
| 2003/0090455 | A1 | 5/2003 | Daly | |
| 2003/0214725 | A1 * | 11/2003 | Akiyama | 359/640 |
| 2004/0046725 | A1 | 3/2004 | Lee et al. | |
| 2004/0085496 | A1 | 5/2004 | Paukshto et al. | |

(Continued)

FOREIGN PATENT DOCUMENTS

| | | | |
|---|---|---|---|
| CA | 2025104 | A1 | 3/1991 |

(Continued)

OTHER PUBLICATIONS

International Search Report for PCT Application No. PCT/CA2004/002200, International Searching Authority, Sep. 26, 2005.

(Continued)

*Primary Examiner*—Amare Mengistu
*Assistant Examiner*—Dmitriy Bolotin

(57) ABSTRACT

A display has a modulator illuminated by an illuminator comprising an array of light sources. The array includes light sources of a plurality of colors. The light sources of different colors are individually controllable. Within each color, the light sources that illuminate different areas on the modulator are individually controllable. The display may provide a high dynamic range and a wide color gamut.

17 Claims, 7 Drawing Sheets

U.S. PATENT DOCUMENTS

| | | | | |
|---|---|---|---|---|
| 2004/0218388 | A1 | 11/2004 | Suzuki | |
| 2005/0162737 | A1 | 7/2005 | Whitehead et al. | |
| 2006/0087866 | A1 | 4/2006 | Ng et al. | |
| 2007/0001994 | A1 * | 1/2007 | Roth | 345/102 |
| 2009/0174638 | A1 | 7/2009 | Brown et al. | |

FOREIGN PATENT DOCUMENTS

| | | | |
|---|---|---|---|
| CA | 1315426 | | 3/1993 |
| JP | 2002099250 | | 4/2002 |
| JP | 2002140038 | | 5/2002 |
| WO | 02/069030 | A2 | 9/2002 |
| WO | 03/077013 | A2 | 9/2003 |
| WO | 2004031844 | A1 | 4/2004 |
| WO | 2006/107369 | A1 | 10/2006 |
| WO | 2006/109271 | A2 | 10/2006 |

OTHER PUBLICATIONS

Seetzen, H. et al., "A High Dynamic Range Display Using Low and High Resolution Modulators", SID 03 DIGST, 2003, pp. 1450-1453.

* cited by examiner

WIDE COLOR GAMUT DISPLAYS

CROSS-REFERENCE TO RELATED APPLICATION

This application is a continuation of application Ser. No. 11/722,707 filed on 24 Dec. 2004 which is the U.S. National Stage of International Application No. PCT/CA04/00220 filed 24 Dec. 2004, which claims the benefit of the filing date of U.S. provisional patent application No. 60/638,122 filed on 23 Dec. 2004 and entitled FIELD SEQUENTIAL DISPLAY OF COLOR IMAGES, which are hereby incorporated by reference herein.

TECHNICAL FIELD

The invention relates to color displays. The invention may be applied to computer displays, television monitors or the like.

BACKGROUND

A typical liquid crystal display (LCD) has a backlight and a screen made up of variable-transmissivity pixels in front of the backlight. The backlight illuminates a rear face of the LCD uniformly. A pixel can be made dark by reducing the transmissivity of the pixel. The pixel can be made to appear bright by increasing the transmissivity of the pixel so that light from the backlight can pass through. Images can be displayed on an LCD by applying suitable driving signals to the pixels to create a desired pattern of light and dark areas.

In a typical color LCD, each pixel is made up of individually controllable red, green and blue elements. Each of the elements includes a filter that passes light of the corresponding color. For example, the red element includes a red filter. When only the red element in a pixel is set to transmit light, the light passes through the red filter and the pixel appears red. The pixel can be made to have other colors by applying signals which cause combinations of different transmissivities of the red, green and blue elements.

Fluorescent lamps are typically used to backlight LCDs. PCT publication No. WO03077013A3 entitled HIGH DYNAMIC RANGE DISPLAY DEVICES discloses a high dynamic range display in which LEDs are used as a backlight.

There is a need for efficient displays. There is a particular need for such displays capable of representing colors in a wide color gamut.

SUMMARY OF THE INVENTION

This invention provides displays. In a display according to an example embodiment of the invention, light from an illuminator is projected onto an active area of a modulator. The illuminator comprises an array of light emitters that are independently controllable. The light emitters can be controlled to project a pattern of illumination onto the active area of the modulator. The modulator can be controlled to display a desired image at a viewing location.

The invention also provides methods for displaying color images.

One aspect of the invention provides a display comprising an illuminator comprising an array of light sources. The light sources include light sources of a plurality of colors. A modulator is disposed to be illuminated by the illuminator. The modulator comprises a plurality of pixels, each having a plurality of elements. An illuminator driver circuit independently controls intensities of the light sources in each of a plurality of areas of the illuminator and, within each of the areas, independently controls intensities of each of the plurality of colors. The light sources in each of the plurality of areas of the illuminator illuminate a corresponding area of the modulator with light having a color and intensity controlled by the illuminator driver circuit. A modulator driver circuit is connected to control modulation of the light from the illuminator by the pixel elements.

In some embodiments of the invention the modulator comprises a liquid crystal display panel and the light sources comprise light-emitting diodes.

In some embodiments of the invention, the light sources of different colors have different maximum light outputs. In such embodiments light sources of colors having greater light outputs may be more widely spaced apart than light sources of colors having lower maximum light outputs.

Another aspect of the invention provides apparatus for displaying images at a viewing area. The apparatus comprises an array comprising a plurality of groups of individually-controllable light sources. the light sources of each group emit light of a corresponding one of a plurality of colors. the apparatus includes a modulator having an active area comprising a plurality of pixels. The active area is illuminated by the array. Each pixel is controllable to vary a proportion of light incident on the active area that is passed to the viewing area. The apparatus further includes a control circuit configured to drive each of the groups of the light sources according to a control signal to project a luminance pattern onto the active area of the modulator. The luminance pattern for each of the groups has a variation in intensity over the active area. The variation is controlled by the control circuit.

Another aspect of the invention provides a method for displaying images at a viewing area. The method comprises: providing an array comprising a plurality of groups of individually-controllable light sources, the light sources of each group emitting light of a corresponding one of a plurality of colors; driving the array in response to a control signal such that each of the groups projects a luminance pattern onto an active area of a modulator comprising a plurality of pixels, the luminance pattern having a variation in intensity with position on the active area determined by the control signal; and, controlling the pixels of the modulator to selectively allow light from the active area to pass to the viewing area.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
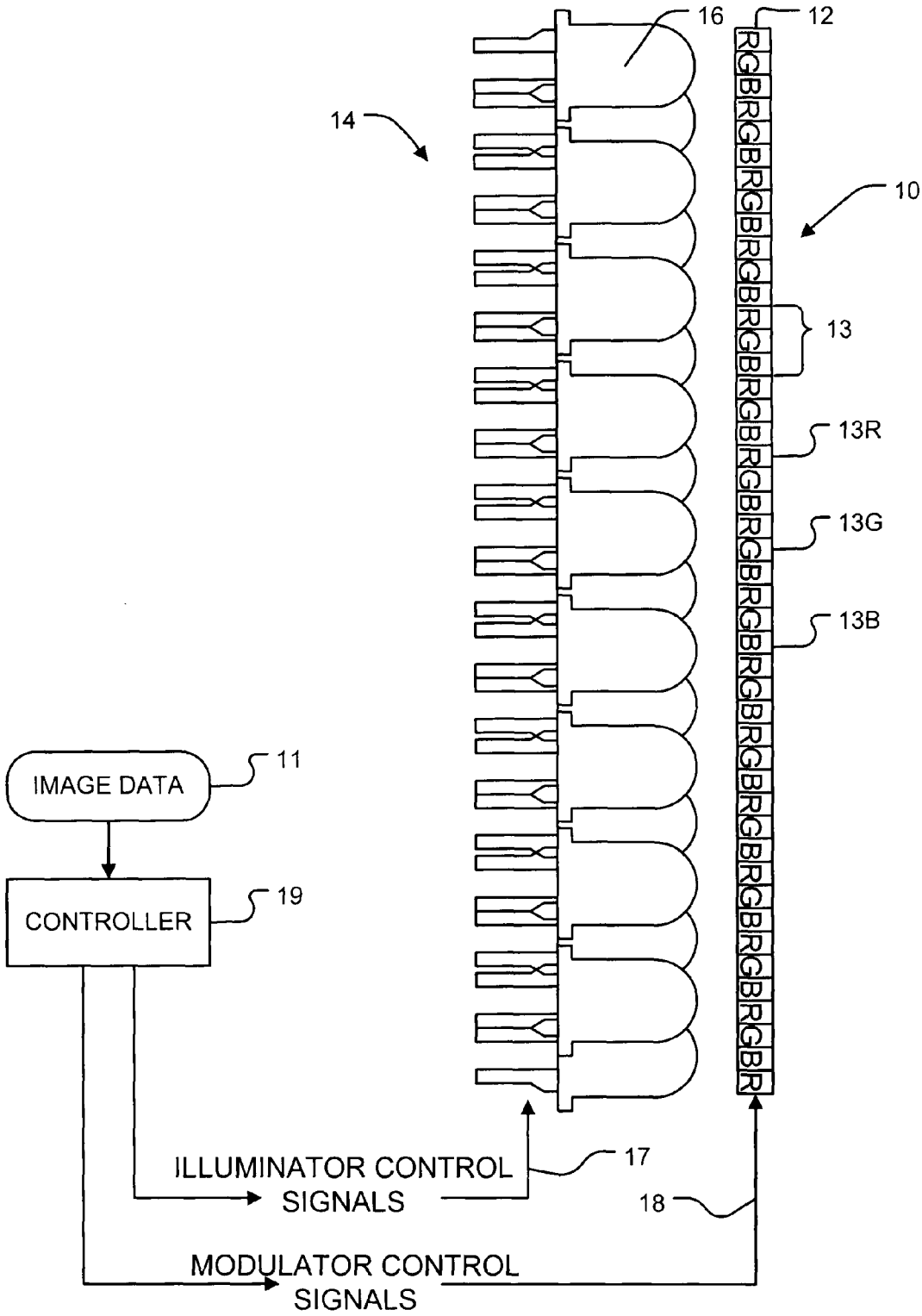
FIG. 1 is a schematic diagram of a display having an illuminator made up of an array of tri-color LEDs.

FIG. 1 shows a display 10 in which a modulator 12, which may be an LCD panel, for example, is backlit by an illuminator comprising an array 14 of light emitters 16. In the illustrated embodiment, light emitters 16 comprise light-emitting diodes (LEDs). In the following description, light emitters 16 are referred to as LEDs 16 and modulator 12 is referred to an LCD panel. Other suitable light sources could be used in place of LEDs 16. Other suitable modulators could be used in place of LCD panel 12.

LEDs 16 include separate emitters of light of different colors that may be combined to form a color image. In the example embodiment of FIG. 1, LEDs 16 include emitters of red, green and blue light. Other color combinations could be provided in alternative embodiments.

The light emitters may be packaged in discrete packages. In some embodiments of the invention two or more emitters of different colors are packaged in a common package. The emitters of each color are controllable independently of emitters of other colors. Emitters of the same color at different locations in array 14 are controllable independently of one another.

The light emitted by LEDs 16 has narrow bandwidths (typically in the range of 20 nm to 50 nm). LCD panel 12 has pixels 13 which include red green and blue elements 13R, 13G and 13B respectively. Color filters of the red, green and blue elements each have a pass band that passes light of a corresponding one of the colors of the light emitted by LEDs 16 and blocks light of the other colors. Display 10 is capable of displaying very saturated red, green and blue colors. In some embodiments of the invention the passbands of color filters of LCD panel 12 are narrow (i.e. less than 150 nm). The passbands may, for example, have bandwidths in the range of 30 to 100 nm. The passbands do not need to be wide because the light emitted by each LED 16 has a narrow spectrum.

In some embodiments, display 10 can be operated in a mode wherein the brightness of each LED 16 is controlled individually as described, for example, in PCT publication No. WO03077013A3. FIG. 1 shows illuminator control signals 17 that control the intensities of LEDs 16 and modulator control signals 18 which control the amounts of light passed by the elements of each of pixels 13.

In some embodiments, illuminator control signals 17 cause suitable driving circuits to separately control the brightness of LEDs 16 of different colors and, within a particular color, to separately control the brightness of LEDs 16 in different spatial locations. This permits illuminator 14 to project onto modulator 12 a pattern of light that has different mixtures of colors at different locations on modulator 12.

FIG. 1 is schematic in nature. The elements of pixels 13 and LEDs 16 may be arranged in any suitable two dimensional arrangements, not necessarily the arrangements shown.

A display may include a controller 19 that generates illuminator control signals 17 and modulator control signals 18 to display a desired image. The desired image may be specified by image data 11 which directly or indirectly specifies luminance values (and, if the image is a color image, color values) for each pixel. Image data 11 may have any suitable format and may specify luminance and color values using any suitable color model. For example, image data 11 may specify:

red, green and blue (RGB) color values for each pixel;

YIQ values wherein each pixel is represented by a value (Y) referred to as the luminance and a pair of values (I, Q) referred to as the chrominance;

CMY or CMYK values;

YUV values;

YCbCr values;

HSV values; or

HSL values.

Figure 1A:
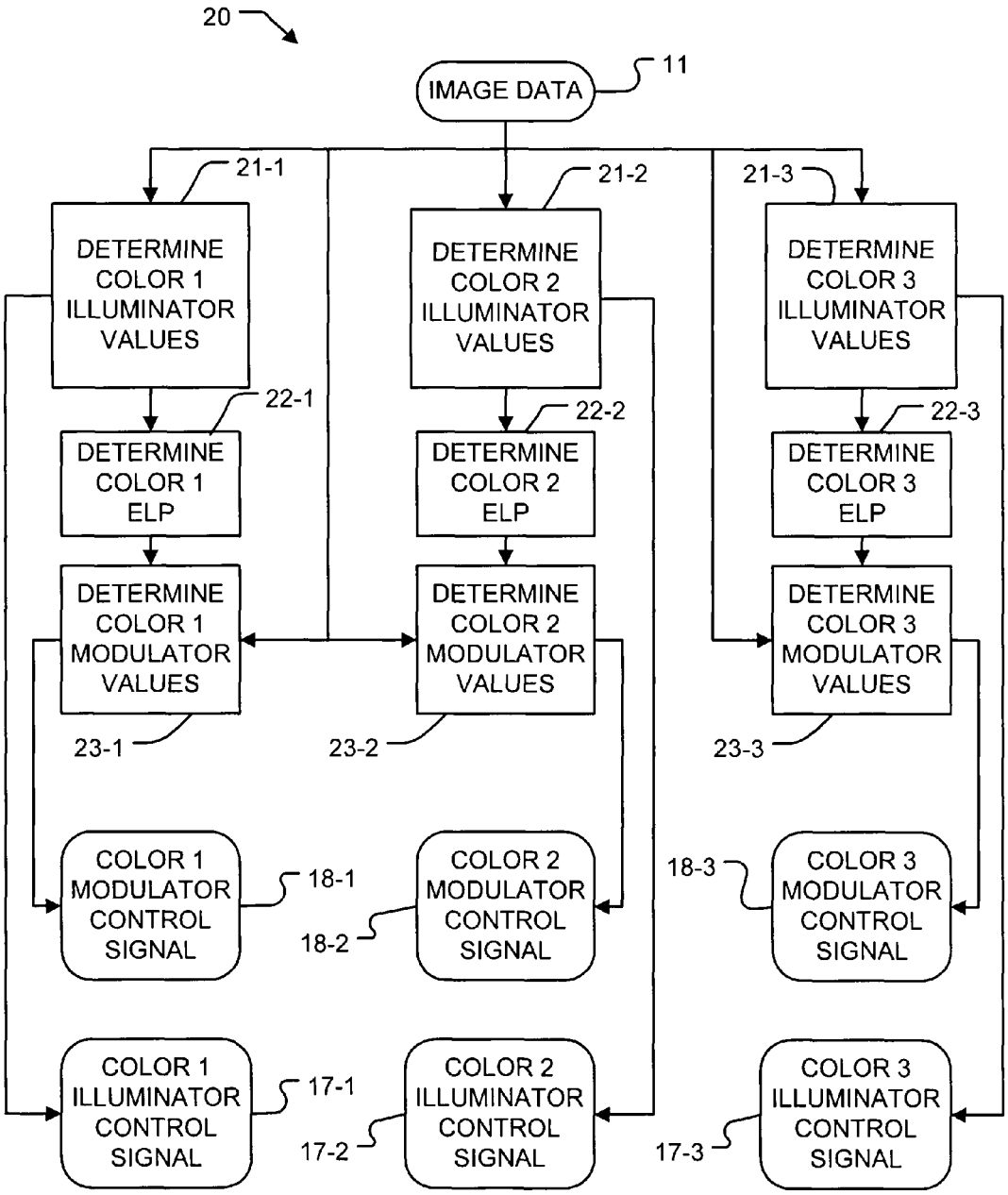
FIG. 1A is a flowchart illustrating a method for generating illuminator and modulator control signals.

FIG. 1A shows a method 20 for generating illuminator control signals 17 and modulator control signals 18. Method 20 begins by generating illuminator control signals 17 from image data 11. This is performed separately in blocks 21-1, 21-2 and 21-3 for each color of LED 16 in array 14. In the embodiment of FIG. 1A, illuminator control signals 17 include signals 17-1, 17-2 and 17-3, each of which controls one color of LED in array 14.

Illuminator control signals 17 may be generated by determining in controller 19 an intensity for driving each of LEDs 16 such that LEDs 16 project a desired luminance pattern onto LCD 12. Preferably, for each of the colors, the luminance of the luminance pattern at each pixel 13 is such that a luminance specified for that pixel 13 by image data 11 can be achieved within the range of modulation of the elements 13R, 13G and 13B for that pixel. That is, it is desirable that the luminance L be such that:

$$L \times T_{MIN} \leq L_{IMAGE} \leq L \times T_{MAX} \quad (1)$$

where: $T_{MIN}$ is the minimum transmissivity of a pixel element; $T_{MAX}$ is the maximum transmissivity of the pixel element; and $L_{IMAGE}$ is the luminance for the pixel specified by image data 11. The relationship of Equation (1) preferably holds separately for each pixel of LED 12 for each color.

Since the relative light output of LEDs 16 of different colors will typically vary from place-to-place on LCD 12, the color of the light projected onto LCD 12 by the emitters of array 14 will typically vary from place-to-place on array 12.

Controller 19 may generate modulator control signals 18 by, for each of the elements of each pixel 13 of LCD 12, dividing the desired luminance specified by image data 11 by the luminance at that element provided by illuminator array 14 when driven by illuminator control signal 17. The luminance provided by illuminator array 14 may be termed an effective luminance pattern ELP. Since each element 13R, 13G or 13B transmits only light of one of the colors of array 14, the ELP may be computed separately for each color and the computation to determine modulator control signals 18 may be performed independently for each color.

Method 20 computes ELPs for each color of light in blocks 22-1, 22-2, and 22-3. Method 20 determines the modulator control signal for each color in blocks 23-1, 23-2 and 23-3. In the embodiment of FIG. 1A, modulator control signals 18 include signals 18-1, 18-2 and 18-3 which respectively control elements of first, second and third colors in modulator 12.

The arrangement of FIG. 1 can be operated in a manner that is energy efficient since the pattern of illumination projected by array 14 onto in any area of LCD 12 can be made to have a color which approximates that of pixels 13 in that area. For example, where image data specifies that an area of an image should be predominantly red, the backlighting of the corresponding area of LCD 12 can be provided entirely or mostly by red emitters of array 14. Blue and green emitters in that area may be turned off or operated at reduced levels.

Figure 2:
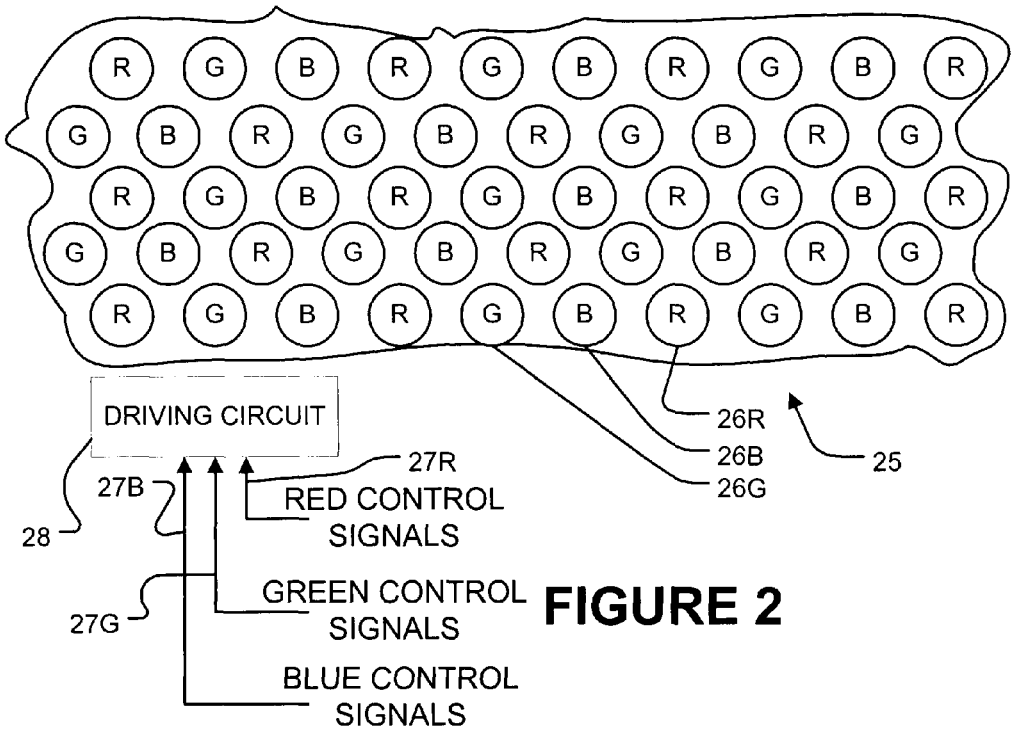
FIG. 2 is a schematic diagram of an illuminator made up of an array of groups of colored LEDs.

FIG. 2 shows an illuminator 25 having a particular arrangement of discrete colored LEDs 26. In illuminator 25, LEDs 26 are arranged in groups 21. Each group 21 includes a red LED 26R, a green LED 26G and a blue LED 26B (collectively LEDs 26). FIG. 2 shows separate illuminator control signals 27R, 27G, and 27B for the red, green and blue LEDs respectively (collectively signals 27). Driving signals 27 cause a driving circuit 28 to control intensities of LEDs 26 to provide a desired luminance pattern on the active area of LCD 12 for each color.

Figure 3:
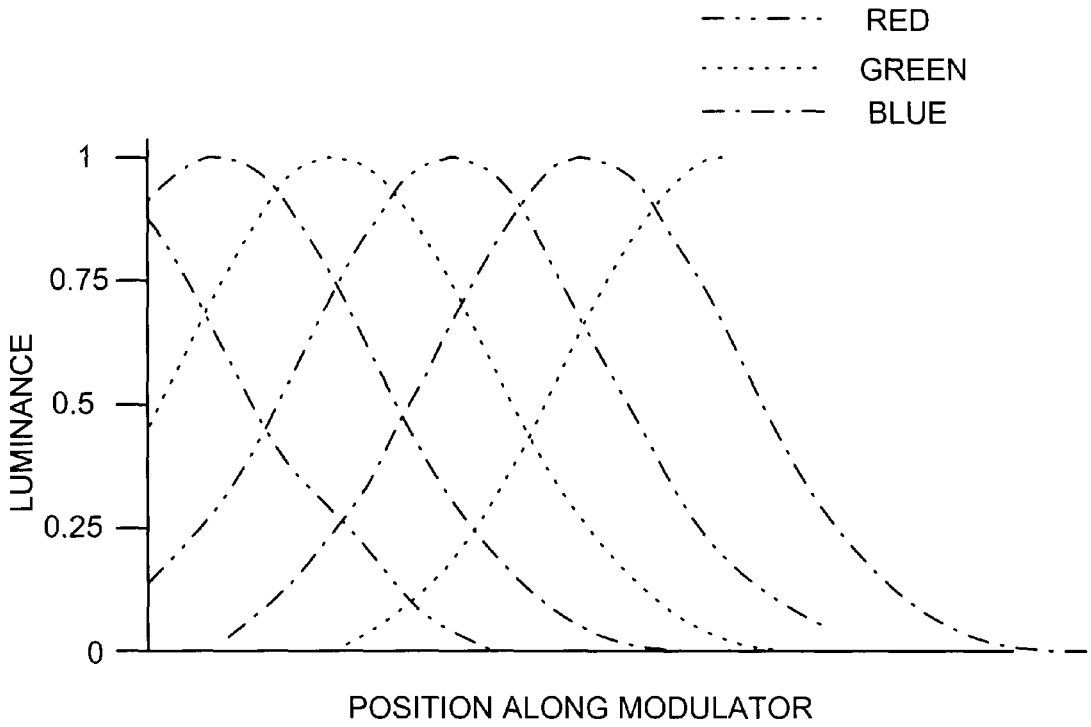
FIG. 3 is a diagram illustrating point spread functions of LEDs in an illuminator of a display.

The even distribution of LEDs 26 permits LEDs 26 to provide relatively uniform illumination of an LCD panel for each color of LED 26. FIG. 3 shows example point spread functions for a number of LEDs 26. In FIG. 3:

- Within each color the point spread functions of adjacent LEDs 26 overlap.
- each of LEDs 26 is operating at a maximum output.
- each LED 26 produces light of the same intensity at the peak of its point spread function (indicated as 1.0 in arbitrary units).
- LEDs 26 of each color are uniformly distributed in illuminator 25.

Figure 4:
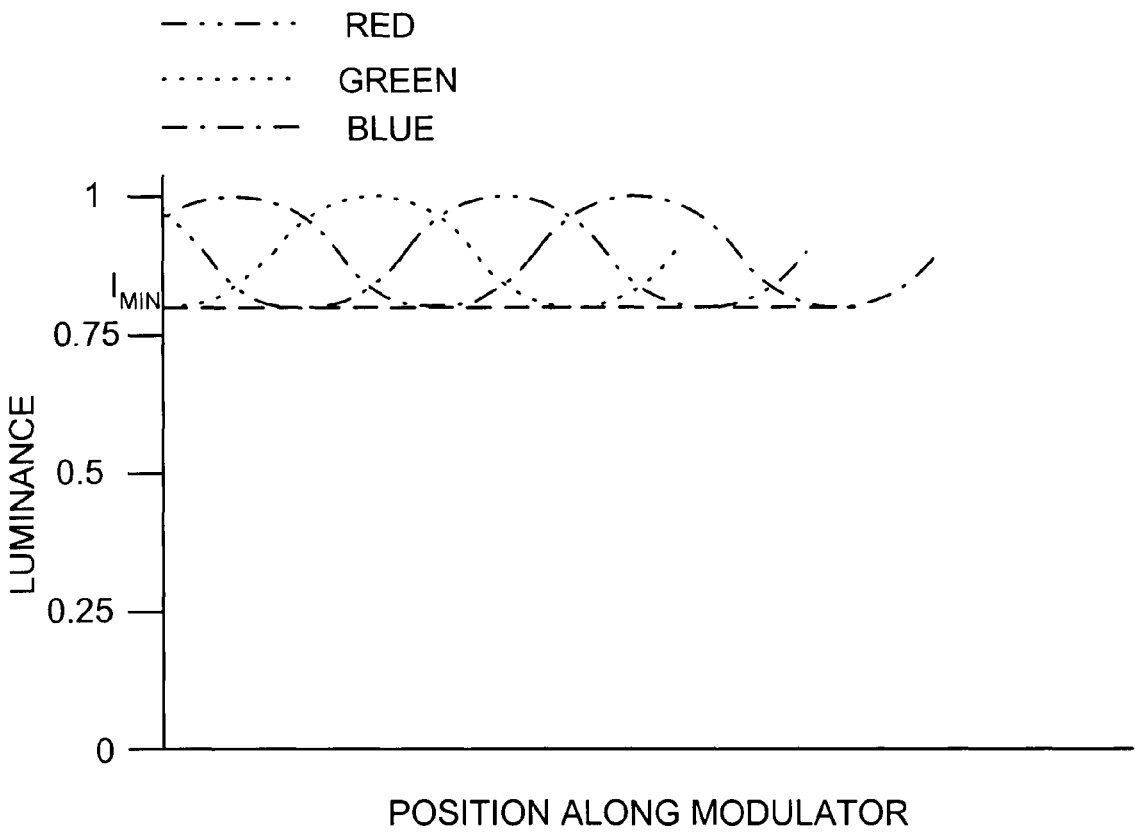
FIG. 4 is a graph illustrating the variation of luminance with position along a line on a modulator illuminated by the LEDs of FIG. 3.

FIG. 4 shows the total intensity as a function of position along a line for each of the colors of the LEDs represented by the point spread functions of FIG. 3. Each of the curves of FIG. 4 can be obtained by adding together the point spread functions for all emitters of one color at each point. It can be seen that, for each color, there is a value $I_{MIN}$ such that the intensity for that color can be made to be greater than or equal to $I_{MIN}$ at every point by suitably controlling the LEDs of the color.

The variation in intensity with position of the ELP for each color may be compensated for by adjusting the transmission of light by modulator 12.

It is not necessary that the maximum intensity of all of LEDs 26 be the same. LEDs of different colors tend to have different efficiencies. Typically the efficiency (the amount of light generated for a given electrical power) of red LEDs is greater than that of green LEDs. Typical red and green LEDs have greater efficiencies than typical blue LEDs. Up to a point, one can obtain brighter LEDs of any available color at greater expense. Those who design displays can select appropriate LEDs on the basis of factors such as maximum light output, electrical power requirements, and cost. Currently it is common to find it most cost effective to provide red, green and blue LEDs having flux ratios of 3:5:1. With such a flux ratio, the red LEDs are three times brighter than the blue LEDs and the green LEDs are five times brighter than the blue LEDs.

Figure 5:
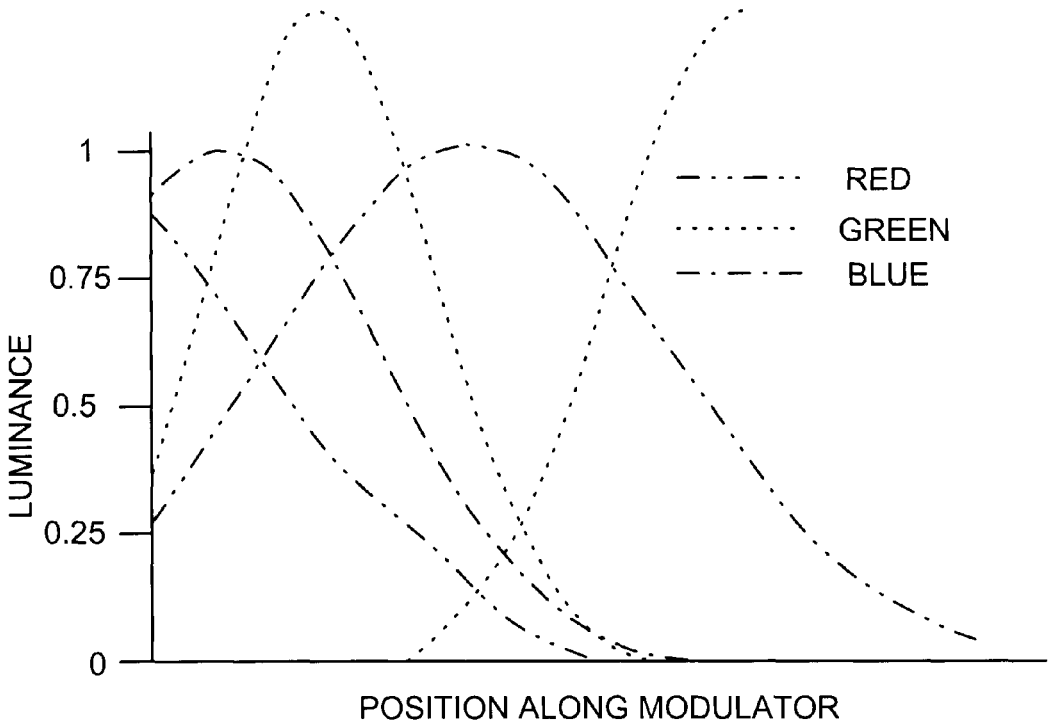
FIG. 5 is a diagram illustrating point spread functions of LEDs in an illuminator of a display wherein LEDs of different colors have different intensities and different point spread functions.

FIG. 5 shows example point spread functions for several LEDs in an embodiment of the invention wherein the green LEDs emit light of greater intensity than the red and blue LEDs which emit light of the same intensities. In FIG. 5, the red LEDs have broader point spread functions than blue LEDs and the blue LEDs have broader point spread functions than blue LEDs. The width of a point spread function may be taken as the full width at half maximum (FWHM).

Figure 6:
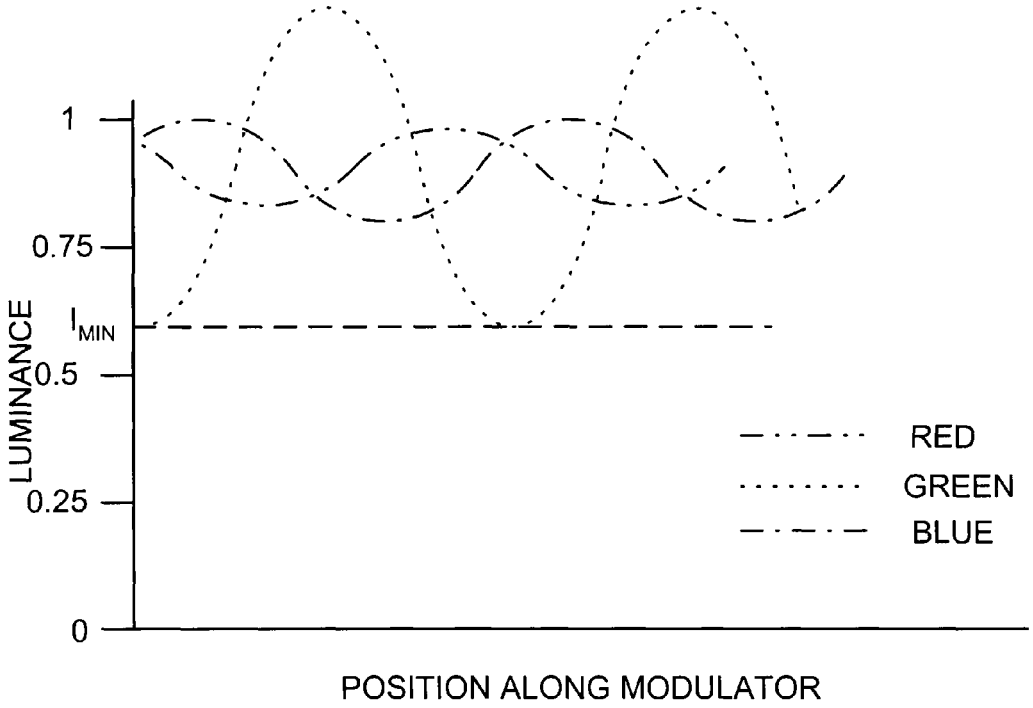
FIG. 6 is a graph illustrating the variation of luminance with position along a line on a modulator illuminated by the LEDs of FIG. 5.

FIG. 6 shows the total intensity as a function of position along a line on a modulator (such as LCD 12) for each of the colors of the LEDs represented by the point spread functions of FIG. 5. It can be seen that $I_{MIN}$ is determined by the green LEDs. Light from the blue and red LEDs can achieve intensities in excess of $I_{MIN}$ everywhere along the line along which the curves of FIG. 6 are measured.

The maximum intensities, point spread functions, and spacings of LEDs of different colors in an illuminator array may be adjusted to achieve a desired value for $I_{MIN}$ without excess wasted power. In some embodiments of the invention, when all of LEDs 26 are at maximum output, a modulator 12 is illuminated quite uniformly with each color of light and the average intensity of light of each color is substantially equal to (i.e. within ±10% or ±15% of) the average intensity of the light of each of the other colors.

In some embodiments, array 14 includes first light sources having point spread functions of a first width and second light sources having point spread functions of a second width. The first and second light sources emit light of different colors. The first and second light sources are each distributed substantially evenly in array 14. A ratio of the distance by which neighboring ones of the first light sources are spaced apart to the distance by which neighboring ones of the second light sources are spaced apart in the display is within a threshold amount, for example 15%, of a ratio of the width of the first and second widths.

In some embodiments of the invention, the number of LEDs of each color in a illuminator 25 is at least approximately inversely proportional to the flux ratio of the LEDs. For example, where an illuminator has LEDs of three colors having flux ratios of 3:5:1, then the numbers of LEDs of each of the three colors in the illuminator could be in the ratio 5:3:15. The LEDs of each color are substantially uniformly distributed on the illuminator. In some embodiments, the point spread functions of the LEDs have widths that increase with the spacing between the LEDs. The point spread functions of the LEDs of one color may have widths that are in direct proportion to the spacing between the LEDs of that color.

Figure 7:
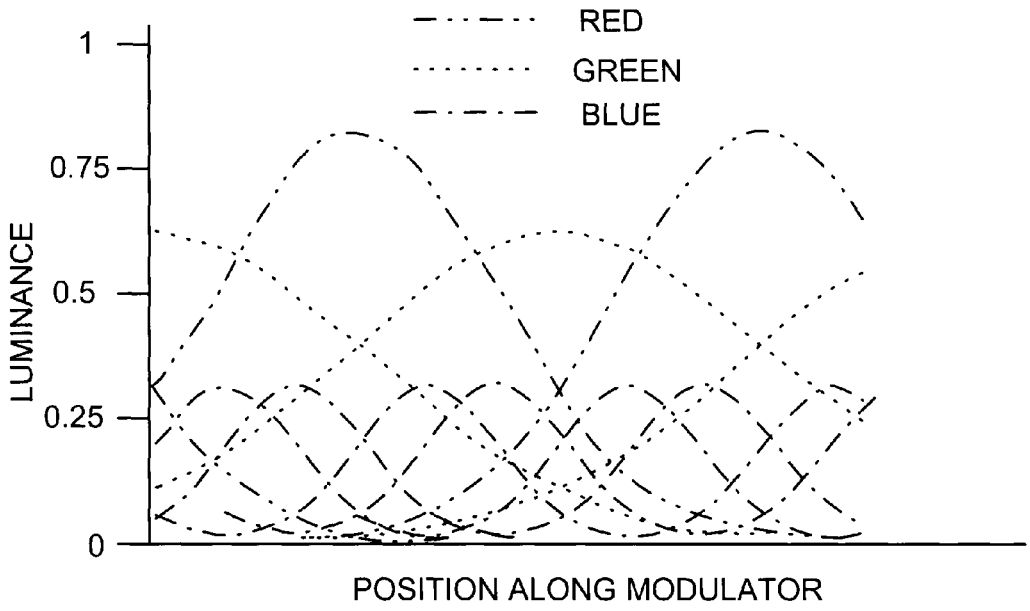
FIG. 7 is a diagram illustrating point spread functions of LEDs in another illuminator of a display wherein LEDs of different colors have different intensities and different point spread functions.

FIG. 6 shows point spread functions for an example set of LEDs. In FIG. 6, the green LEDs are more intense than, more widely spaced apart than, and have wider point spread functions than the red or blue LEDS. The red LEDs have maximum intensities, spacings, and point spread function widths intermediate those of the green and blue LEDs. FIG. 7 shows the total intensity as a function of position along a line on a modulator (such as LCD 12) for each of the colors of the LEDs represented by the point spread functions of FIG. 6.

Some embodiments of the invention provide illuminators having independently-controllable light emitters of more than three colors. For example, yellow or cyan light emitters may be provided in addition to red, green and blue light emitters. Each pixel of modulator 12 may have elements corresponding to each color of light emitted by illuminator 14. For example, where the illuminator includes red, green, blue and yellow light emitters, each pixel of modulator 12 may have an element that transmits the red light, an element that transmits the green light, an element that transmits the blue light and an element that transmits the yellow light.

In some embodiments of the invention, the pixels of modulator 12 include elements that pass, at least partially, two or more colors of light emitted by illuminator 14. An element that passes two or more colors may be called a broadband element. For example, RGBW LCD panels which include red, green, blue and white elements are available. In such panels the white elements lack filters and so will pass light of any color. The white elements may be called broadband elements.

The broadband elements may be used to increase the brightness of pixels. Because the color of light projected onto modulator 12 by illuminator 14 can be made to approximate the color of the pixel, the brightness of the pixel may be increased by increasing the transmission of light by a broadband element (preferably a "white" broadband element) without significantly decreasing the color saturation of the pixel.

In some embodiments, broadband elements in the pixels are used to control an additional primary color. For example, a white element in a pixel may be used to pass light of one of the colors provided by the illuminator while other elements in the pixel each have filters which pass one other color provided by the illuminator. For example, a RGBW LCD panel may be backlit by an array of light emitters which generate light of basic colors, such as red, green, blue and an additional color, for example, yellow light. The red green and blue light is modulated by corresponding red, green and blue elements in the LCD panel. The yellow light is modulated by the white elements in the LCD panel.

In such embodiments of the invention there are three basic image cases for an image area corresponding to one group of light emitters of the illuminator. These are:

- The image area is without saturated yellow. In this case the image can be reproduced without regard to the white pixel. The white pixel may be left off. In the alternative, the white pixel may be opened to allow more RGB light to pass through as appropriate. The yellow LED of the illuminator is off or only on to the extent that it supports the RGB colour brightness in white areas.
- The color of pixels in the image area is predominantly saturated yellow. In this case the red, green and blue LEDs corresponding to the area are substantially off or dim and the yellow LED(s) is on at a bright level. The white sub-pixel is now used predominantly to modulate yellow light from the yellow LED.
- The image area includes a mix of pixels, some displaying saturated yellow and others having significant red, green or blue components. In this case, the illuminator illuminates the pixels of the area with light of all four LED colours. The white pixel elements of the modulator can be opened to allow the yellow light components to pass. The white pixel elements will also allow red green and blue light to pass. The result will be an appropriate yellow area which is slightly desaturated by the RGB light passing through the white filter. This desaturation can be minimized by reducing the light passing through red, green or blue elements of pixels that should be yellow. The slight desaturation is generally acceptable because yellow portions of the area will be small (or this would be an example of the second case). Providing yellow LEDs which can illuminate the modulator with yellow light which is somewhat brighter than the red, green or blue light components can further reduce the desaturation.

Figure 8:
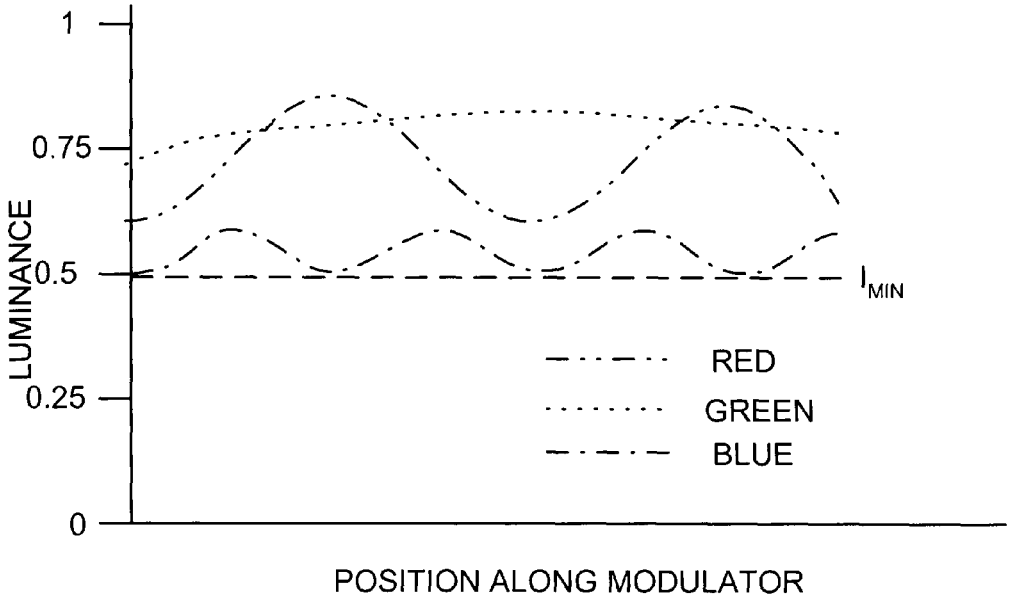
FIG. 8 is a graph illustrating the variation of luminance with position along a line on a modulator illuminated by the LEDs of FIG. 7; and, FIG. 9 is a flow chart illustrating a method for correcting for light that passes through broadband pixel elements that pass two or more colors of light.

In some embodiments, controller 19 corrects modulator control signals for the elements corresponding to the basic colors to compensate for the fact that light of the basic colors passes through the broadband elements. FIG. 8 illustrates a method 60 which may be used to provide this compensation. In block 62 method 60 determines illuminator values 63-1, 63-2, 63-3, for a number of basic colors and illuminator values 63-4 for an extra color. Illuminator values may be obtained in any suitable manner. The illuminator values specify the brightness of light sources in illuminator 14.

In block 64 method 60 determines the ELP for all of the colors. Block 66 determines modulator values 67 for the broadband pixel elements. The extra pixel modulator values 67 are selected to allow desired amounts of the extra color to pass through each pixel.

Block 68 determines modulator values 69-1, 69-2 and 69-3 respectively for the pixel elements corresponding to the basic colors. These basic color modulator values may be determined by, for each pixel and each basic color:

- Ascertaining from image data 11 a desired amount of light of the basic color that should pass the modulator for that pixel;
- Subtracting the amount of light of that basic color that will be passed by the broadband pixel (this amount can be ascertained from the ELP for that basic color and extra color modulator values 67); and,
- Selecting a modulator value for the element of the basic color to let pass the additional light of the basic color (if any) required to make the total amount of light of the basic color that is passed in the pixel equal to the desired amount.

Certain implementations of the invention comprise computer processors which execute software instructions which cause the processors to perform a method of the invention. For example, one or more processors in a controller 19 may implement the method of FIGS. 1A and/or 8 by executing software instructions in a program memory accessible to the processors. The invention may also be provided in the form of a program product. The program product may comprise any medium which carries a set of computer-readable signals comprising instructions which, when executed by a computer processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like or transmission-type media such as digital or analog communication links.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

- the light sources in an illuminator in a display according to the invention are not necessarily LEDs but may be other types of light source.
- the light sources in an illuminator in a display according to the invention are not necessarily red, green and blue but may be of other colors.
- a light source in an illuminator in a display according to the invention may be made up of more than one light emitter.

an illuminator may include more or fewer than three different colors of light source (although at least three colors are generally required if a full color gamut is to be achieved.

Figure 9:
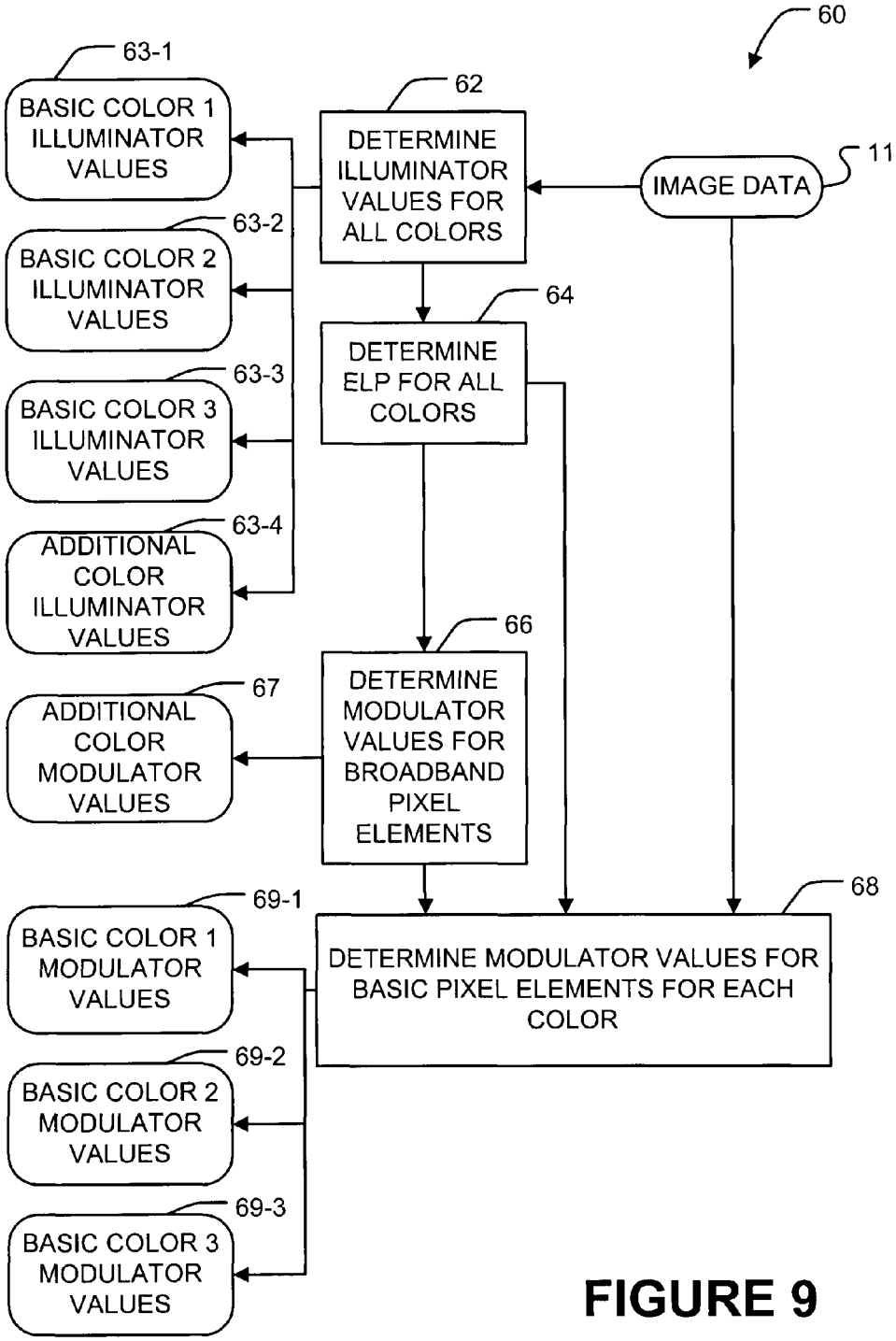

The actions of the blocks of the methods of FIGS. 1A and 9 may be performed partly or entirely in different orders in cases where the result from one block is not required to commence the actions of block illustrated as being next in sequence. For example, the ELP for the basic colors are not required until block 68 of FIG. 9. The ELP for the basic colors could be determined at any time between blocks 62 and 68.

Accordingly, the scope of the invention is to be construed in accordance with the substance defined by the following claims.

What is claimed is:

1. A display comprising:

an illuminator comprising a plurality of groups of arrayed light sources of a corresponding plurality of colors, each group of light sources arranged to illuminate a modulator and controllable to generate a controllably-variable two-dimensional pattern of light of the corresponding color on the modulator;

the modulator comprising a plurality of pixels each having a plurality of elements, the elements of each of the pixels including a plurality of color elements each having a color corresponding to the color of one of the plurality of groups of light sources, the color elements each having a filter capable of passing light from a corresponding one of the plurality of groups of light sources while substantially blocking light from other ones of the plurality of groups of light sources, the color elements each controllable to vary a proportion of light of the corresponding color incident on the color element from the corresponding group of light sources that is passed to a viewing area, the elements of the pixels including at least one broadband element capable of passing light of two or more of the plurality of colors to the viewing area;

an illuminator driver circuit configured to independently control intensities of different ones of the light sources in each of the plurality groups;

a modulator driver circuit configured to control the proportions of light passed by the pixel elements to the viewing area; and a controller configured to, for pixels of the modulator:

ascertain from image data a desired amount of light for one of the plurality of colors that should pass to the viewing area;

subtract from the desired amount an amount of light of the one color that will be passed by the broadband element; and, set the color element corresponding to the one color to pass to the viewing area sufficient light of the one color so that the desired amount of the light of the one color is passed to the viewing area.

2. A display according to claim 1 wherein the filters of the color elements have pass bands having widths greater than bandwidths of the light of the corresponding color that can be emitted by the corresponding group of the light sources.

3. A display according to claim 2 wherein the passbands of the color elements have widths of 150 nm or less.

4. A display according to claim 3 wherein the light emitted by the light sources has bandwidths of 50 nm or less.

5. A display according to claim 1 wherein the modulator comprises a liquid crystal display panel.

6. A display according to claim 1 wherein the light sources comprise light-emitting diodes.

7. A display according to claim 1 wherein the plurality of groups of arrayed light sources includes a first group of arrayed light sources capable of emitting red light; a second group of arrayed light sources capable of emitting green light; and a third group of arrayed light sources capable of emitting blue light.

8. A display according to claim 1 wherein the light emitters of the plurality of groups of arrayed light emitters are interspersed with one another in a common array.

9. A display according to claim 1 wherein the controller is configured to determine expected light patterns on the modulator of the two-dimensional patterns of light and to set the color elements of the modulator based in part on the corresponding expected light pattern.

10. A display according to claim 1 comprising an additional group of arrayed light sources capable of emitting light of an additional color, the additional group of light sources arranged to illuminate the modulator and controllable to generate a controllably-variable two-dimensional pattern of light of the additional color on the modulator, the additional color capable of being passed to the viewing area only by the broadband elements.

11. A display according to claim 10 wherein the additional color is yellow.

12. A display according to claim 1 wherein light sources of each of the groups of light sources are spaced apart from one another with an inter-light-source spacing and the inter-light-source spacing for a first one of the groups of light sources is different from the inter-light-source spacing of a second one of the groups of light sources.

13. A display according to claim 12 wherein a ratio of the inter-light-source spacing of the first group of light sources to the inter-light-source spacing of the second group of light sources is within 15% of a ratio of a width of a point spread function of the light sources of the first group of light sources to a width of a point spread function of the second group of light sources.

14. A display according to claim 1 wherein the illuminator comprises a light emitting diode (LED) backlight, the light sources of one or more of the groups of arrayed light sources may be locally dimmed and power consumption is thereby lowered.

15. A display according to claim 14 comprising a controller configured to reduce brightness of the illuminator in areas corresponding to dark areas of an image.

16. A display according to claim 1 wherein the display is a display of a television monitor and the illuminator comprises a light emitting diode (LED) backlight.

17. A controller for a display comprising an illuminator, a modulator, an illuminator driver circuit and a modulator driver circuit, the illuminator comprising a plurality of groups of arrayed light sources of a corresponding plurality of colors, each group of light sources arranged to illuminate the modulator and controllable to generate a controllably-variable two-dimensional pattern of light of the corresponding color on the modulator, the modulator comprising a plurality of pixels each having a plurality of elements, the elements of each of the pixels including a plurality of color elements each having a color corresponding to the color of one of the plurality of groups of light sources, the color elements each having a filter capable of passing light from a corresponding one of the plurality of groups of light sources while substantially blocking light from other ones of the plurality of groups of light sources, the color elements each controllable to vary a proportion of light of the corresponding color incident on the color element from the corresponding group of light sources that is passed to a viewing area, the elements of the pixels including at least one broadband element capable of passing light of two or more of the plurality of colors to the viewing area, the illuminator driver circuit configured to independently control intensities of different ones of the light sources in each of the plurality groups, the modulator driver circuit configured to control the proportions of light passed by the pixel elements to the viewing area, the controller configured to, for pixels of the modulator:

ascertain from image data a desired amount of light for one of the plurality of colors that should pass to the viewing area;

subtract from the desired amount an amount of light of the one color that will be passed by the broadband element and, set the color element corresponding to the one color to pass to the viewing area sufficient light of the one color so that the desired amount of the light of the one color is passed to the viewing area, and configured to determine expected light patterns on the modulator of the two-dimensional patterns of light and to set the color elements of the modulator based in part on the corresponding expected light pattern.

* * * * *